US011414966B2

(12) United States Patent
Moneyhun et al.

(10) Patent No.: US 11,414,966 B2
(45) Date of Patent: Aug. 16, 2022

(54) GAS-LIFT TREATMENT SYSTEM

(71) Applicant: Moneyhun Equipment Sales & Service Co., Inc., Rock Springs, WY (US)

(72) Inventors: David Moneyhun, Rock Springs, WY (US); Bernie Claydon, Kelowna (CA); Evan Visser, Springs, TX (US)

(73) Assignee: MONEYHUN EQUIPMENT SALES & SERVICE CO., INC., Rock Springs, WY (US)

( * ) Notice: Subject to any disclaimer, the term of this patent is extended or adjusted under 35 U.S.C. 154(b) by 0 days.

(21) Appl. No.: 17/215,374

(22) Filed: Mar. 29, 2021

(65) Prior Publication Data

US 2021/0301634 A1 Sep. 30, 2021

Related U.S. Application Data

(60) Provisional application No. 63/001,784, filed on Mar. 30, 2020.

(51) Int. Cl.

| | |
|---|---|
| ***E21B 43/12*** | (2006.01) |
| ***E21B 15/00*** | (2006.01) |
| ***E21B 36/00*** | (2006.01) |
| ***E21B 43/34*** | (2006.01) |

(52) U.S. Cl.

CPC ..... *E21B 43/122* (2013.01); *E21B 15/003* (2013.01); *E21B 36/001* (2013.01); *E21B 43/34* (2013.01)

(58) Field of Classification Search

CPC .... E21B 43/122; E21B 15/003; E21B 36/001; E21B 43/34

See application file for complete search history.

(56) References Cited

U.S. PATENT DOCUMENTS

| | | | | |
|---|---|---|---|---|
| 2,245,028 | A * | 6/1941 | Farris | E21B 43/34 62/633 |
| 6,955,704 | B1 * | 10/2005 | Strahan | C10L 3/102 55/482 |
| 7,484,385 | B2 * | 2/2009 | Patel | F25J 3/0238 62/620 |
| 10,561,977 | B2 * | 2/2020 | Johannessen | E21B 43/36 |
| 11,319,217 | B2 * | 5/2022 | DiBenerdini | C02F 1/048 |

(Continued)

OTHER PUBLICATIONS

Meyer, James M., "Natural Gas Conditioning Cross-Reference to Related Application," U.S. Appl. No. 16/576,394, filed Sep. 19, 2019, pp. 22.

(Continued)

*Primary Examiner* — Jonathan Malikasim

(74) *Attorney, Agent, or Firm* — Thorpe, North & Western, LLP

(57) ABSTRACT

A lift gas treatment system and method for treating lift gas by a high-pressure separation of heavy hydrocarbons and water from the gas stream to be used as lift gas. The system and method first remove water from the lift gas in a first separator. The lift gas is then cooled in a pair of heat exchangers. A second separator separates natural gas liquids (NGLs) from the lift gas. The NGLs are passed through a valve to reduce the temperature and passed to the second heat exchanger. The lift gas is passed through the first heat exchanger to raise the temperature.

14 Claims, 3 Drawing Sheets

(56) References Cited

U.S. PATENT DOCUMENTS

| | | | | |
|---|---|---|---|---|
| 2007/0227186 | A1* | 10/2007 | Alferov | B01D 5/0033 62/620 |
| 2021/0002989 | A1* | 1/2021 | Moneyhun | E21B 36/001 |
| 2021/0317378 | A1* | 10/2021 | Moneyhun | B01D 53/265 |

OTHER PUBLICATIONS

Meyer, James M., "Natural Gas Conditioning," U.S. Appl. No. 62/846,789, filed May 13, 2019, pp. 10.

* cited by examiner

GAS-LIFT TREATMENT SYSTEM

PRIORITY CLAIM

Priority is claimed to U.S. Provisional Patent Application Ser. No. 63/001,784, filed Mar. 30, 2020, which is hereby incorporated herein by reference.

BACKGROUND

The present invention relates generally to a gas-lift treatment system or a Gas-Lift Motive Gas Processing (GLMGP) system for capture and extraction of natural gas liquids (or NGLs).

Raw natural gas sources include but are not limited to: oil production associated gas, oil tank vapor recovery systems, pipeline gathering systems, facility flare gas, and landfill gas. With respect to oil production, some wells do not contain enough pressure for oil to rise to the surface without stimulation. Artificial lift is a process used to increase pressure within a reservoir to encourage oil to the surface. One artificial lift method is gas-lift. Gas-lift injects compressed gas into the well to reestablish pressure. Typically, the gas that is injected into the well is recycled gas from the well itself. Natural gas may contain quantities of water and high molecular weight hydro-carbon components (condensate). The use of raw unprocessed lease gas, as the motive force, for gas-lift artificial lift is standard practice in many operating regions throughout the world and has proven, in many cases, to be a cost effective and reliable system. However, some regions, such as North Dakota, have unique characteristics which makes gas-lift operations more challenging, effecting the reliability and economics of these systems.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
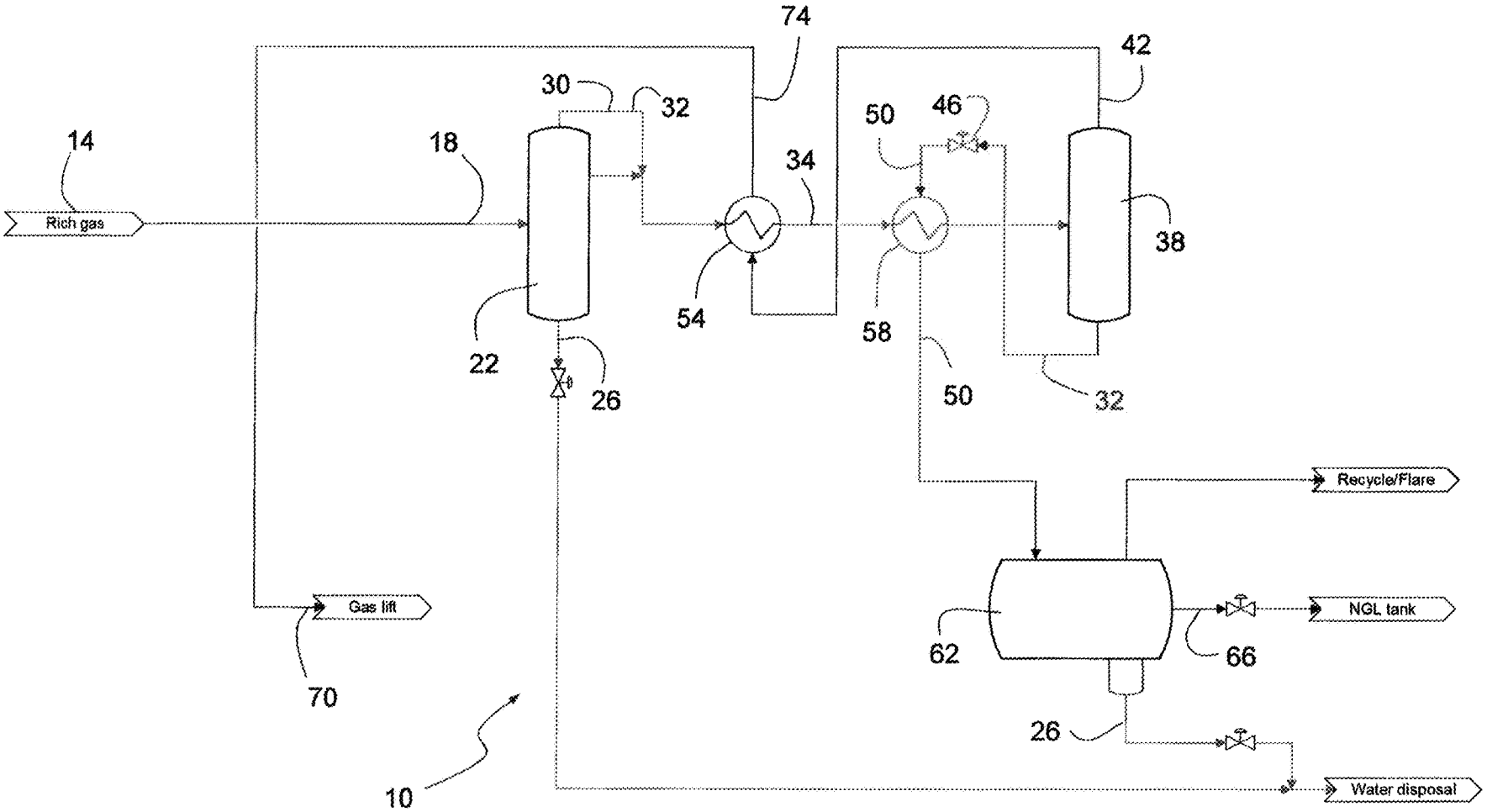
FIG. 1 is a schematic pipe diagram of a gas-lift treatment system in accordance with one embodiment.

Reference will now be made to the exemplary embodiments illustrated, and specific language will be used herein to describe the same. It will nevertheless be understood that no limitation of the scope of the invention is thereby intended.

DETAILED DESCRIPTION

Before invention embodiments are disclosed and described, it is to be understood that no limitation to the particular structures, process steps, or materials disclosed herein is intended, but also includes equivalents thereof as would be recognized by those ordinarily skilled in the relevant arts. It should also be understood that terminology employed herein is used for the purpose of describing particular examples only and is not intended to be limiting. The same reference numerals in different drawings represent the same element. Numbers provided in flow charts and processes are provided for clarity in illustrating steps and operations and do not necessarily indicate a particular order or sequence. Unless defined otherwise, all technical and scientific terms used herein have the same meaning as commonly understood by one of ordinary skill in the art to which this disclosure belongs.

As used in this specification and the appended claims, the singular forms "a," "an" and "the" include plural referents unless the context clearly dictates otherwise. Thus, for example, reference to "a layer" includes a plurality of such layers.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the composition's nature or characteristics would be permissible if present under the "consisting essentially of" language, even though not expressly recited in a list of items following such terminology. When using an open ended term in the specification, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein.

The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, the term "about" is used to provide flexibility to a numerical range endpoint by providing that a given value may be "a little above" or "a little below" the endpoint. It is understood that express support is intended for exact numerical values in this specification, even when the term "about" is used in connection therewith.

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

It has been recognized that it would be advantageous to develop a system and method for regaining the reliability and efficiency of gas-lift artificial lift systems regardless of operating and weather conditions. In addition, it has been recognized that it would be advantageous to develop a system and method to process wet or rich lease gas into warm dry motive gas. Furthermore, it has been recognized that it would be advantageous to develop a system and method to eliminate surface freeze-ups, due to hydrate formation, and reduce downhole problems, such as salt plug formation and mandrel failures, due to corrosion associated with high water saturation and methanol usage in the lift gas.

This invention presents a system and method for a gas-lift treatment system or a Gas-Lift Motive Gas Processing (GLMGP) system for treating high-pressure and high-temperature lift gas by a high-pressure separation of heavy hydrocarbons and water from the wet or rich gas stream to be used as warm dry motive gas or lift gas. In one aspect, the system and method first removes condensed water from the rich lift gas in a first separator. The lift gas is then cooled in a pair of heat exchangers. A second separator separates additional condensed water and natural gas liquids (NGLs) from the lift gas. The NGLs are passed through a valve to reduce the temperature and then passed to the second heat exchanger. The lift gas is passed through the first heat exchanger to raise its temperature. NGLs can then be stabilized in a 3-phase separator for their commercialization.

Referring to FIG. 1, a gas-lift treatment system 10 is shown in one embodiment. The system 10 can process wet or rich lease gas into warm dry motive gas or lift gas. The gas lift treatment system 10 can be designed for high-pressure separation of heavy hydrocarbons and water from the gas stream to be used as lift gas. The system can be designed to operate at high-pressures required for gas lift (600-1200 psig) and high-temperatures typically found at the discharge of a natural gas compressor (60-120 F). The system can also be designed to operate at conditions which minimize the potential for natural gas hydrates, thus eliminating the need for methanol injection. The system 10 can receive the rich gas from a high-pressure and high-temperature wet or rich lift gas source 14, such as the discharge of the natural gas compressor or well head.

The system 10 can comprise an inlet 18 coupled to the rich lift gas source 14. The system 10 can comprise a pair of separators, including a first separator 22 that can be coupled to the inlet 18 to receive the rich lift gas. The first separator 22 separates condensed water (indicated at 26) from the high-pressure and high-temperature rich lift gas, resulting in high-pressure and high-temperature pre-conditioned lift gas (indicated at 30) containing high-pressure and high-temperature hydrocarbon liquids (indicated at 32). Thus, the system 10 and method can be based on first selectively removing water 26 from the hydrocarbons 32 in the first separator 22. This permits a Joule-Thomson (JT) effect, described below, of the expandable hydrocarbon liquids 32 to be more pronounced, since water acts as a heat sink, making it possible to maximize cooling of the high-pressure hydrocarbon stream 34.

The system 10 can also comprise a second separator 38 coupled to the first separator 22 to receive the pre-conditioned lift gas 30 to separate the hydrocarbon liquids 32 and additional condensed water from the pre-conditioned lift gas 30, resulting in separated cooled lower-density lift gas (indicted at 42) and hydrocarbon liquids 32.

A throttling device, such as a valve 46, can be coupled to the second separator 38 to receive the hydrocarbon liquids 32 to expand the hydrocarbon liquids 32 in a throttling or Joule-Thomson effect to reduce the pressure and temperature of the hydrocarbon liquids 32 resulting in low-temperature and low-pressure hydrocarbon liquids (indicated at 50). As stated above, removing the water 26 from the hydrocarbon liquids 32 in the first separator 22 allows the Joule-Thomson effect to be more pronounced and maximizes cooling of the hydrocarbon stream 34, and both the pre-conditioned lift-gas 30 and the hydrocarbon liquids 32.

The system 10 can also comprise a pair of heat exchangers, and namely first and second heat exchangers 54 and 58, to cool the incoming pre-conditioned lift gas 30 and hydrocarbon liquids 32, while heating the outgoing lift gas 42. Cooling is performed using the heat exchangers 54 and 58 which transfer heat from the raw gas or pre-conditioned lift gas 30 to the treated gas or conditioned lift gas 42. The first heat exchanger 54 can be coupled between the first and second separators 22 and 38, and to the second separator 38, to transfer heat from the pre-conditioned lift gas 30 to the separated cooled lower-density lift gas 42. The second heat exchanger 58 can be coupled between the first heat exchanger 54 and the second separator 38, and to the second separator 38, to transfer heat from the pre-conditioned lift gas 30 to the low-temperature and low-pressure hydrocarbon liquids 50.

The system 10 can also comprise a third 3-phase separator 62 coupled to the second separator 38 and second heat exchanger 58 to receive the low-temperature and low-pressure hydrocarbon liquids 50 and to separate water 26, flashed hydrocarbon gases, and natural gas liquids (NGL) (indicated at 66) from the low-temperature and low-pressure hydrocarbon liquids 50. In the 3-phase separator 62, the NGL stream can be stabilized, and water 26 and light gases can be removed from the NGLs 66. NGLs 66 are separated from the hydrocarbon gases at the coldest point, i.e. the third separator 62, to maximize NGL 66 separation. The NGLs 66 can be marketed.

The system 10 can also comprise a treated lift gas outlet 70 coupled to the second separator 38 and the first heat exchanger 54 to provide heated lower-density lift gas (indicated at 74). The lift gas outlet 70 can be coupled to and provided to a gas-lift artificial lift system associated with a well.

Figure 2:
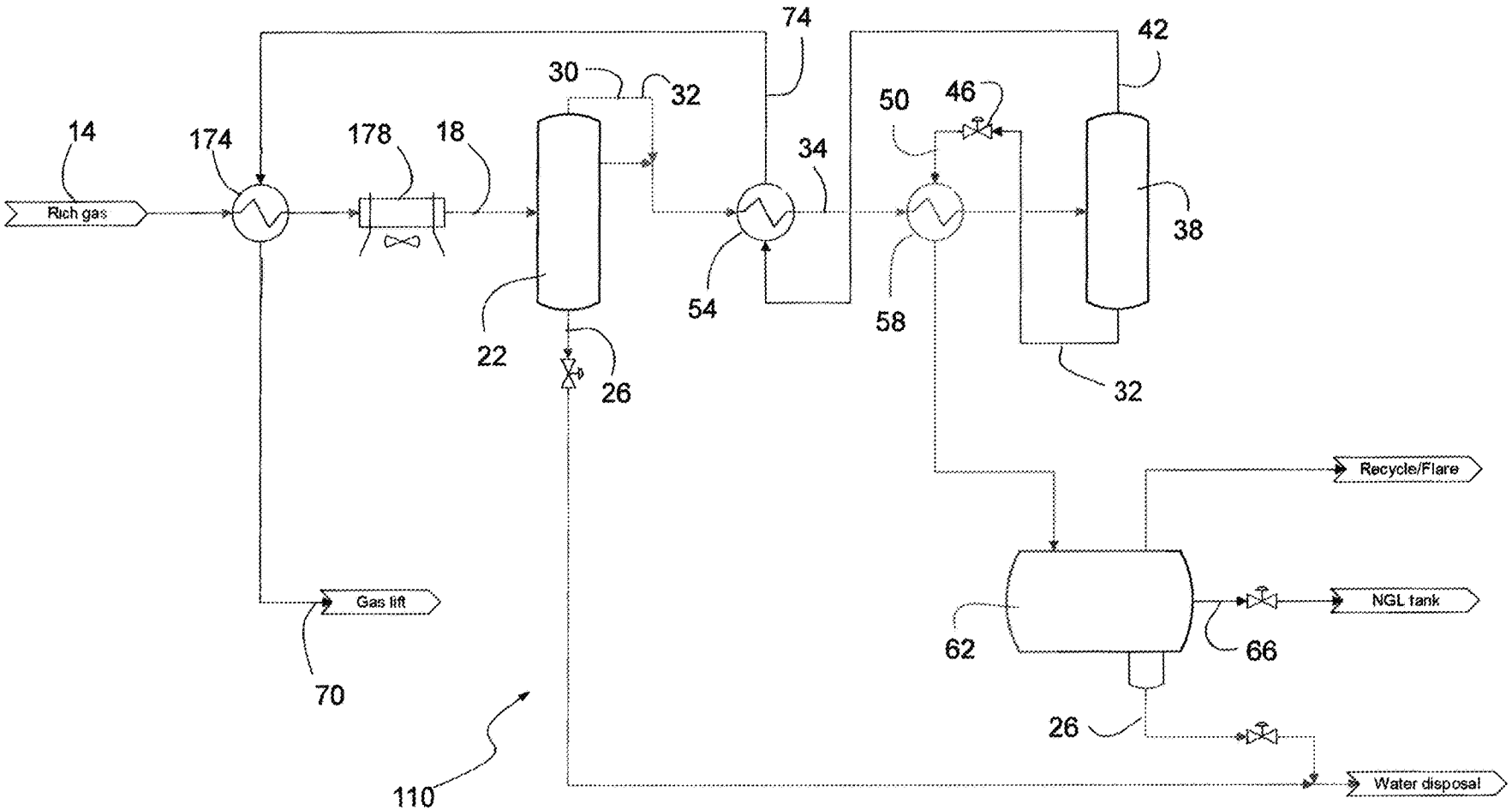
FIG. 2 is a schematic pipe diagram of another gas-lift treatment system in accordance with another embodiment.

Referring to FIG. 2, another gas-lift treatment system 110 is shown in accordance with another embodiment. The system 110 is similar in many respects to the system 10 described above, and which description is hereby incorporated herein by reference. The description of the system 110 applies to the system 10 above as well. In one aspect, the system 110 can further comprise a heat recovery exchanger 174 coupled upstream of a compressor aftercooler 178. The heat recovery exchanger 174 can be coupled before the first separator 22 to transfer heat from the rich gas to the low-density conditioned lift gas 42. The heat recovery exchanger 174 can be placed between the final stage of the compressor and the aftercooler to further heat the treated lift gas 42. This is to mitigate potential problems that might be faced on a gas lift site where cold lift gas results in hydrate formation or requires methanol injection. Thus, the system 110 has an integrated heat recovery loop to control the temperature of the processed lift gas.

Figure 3:
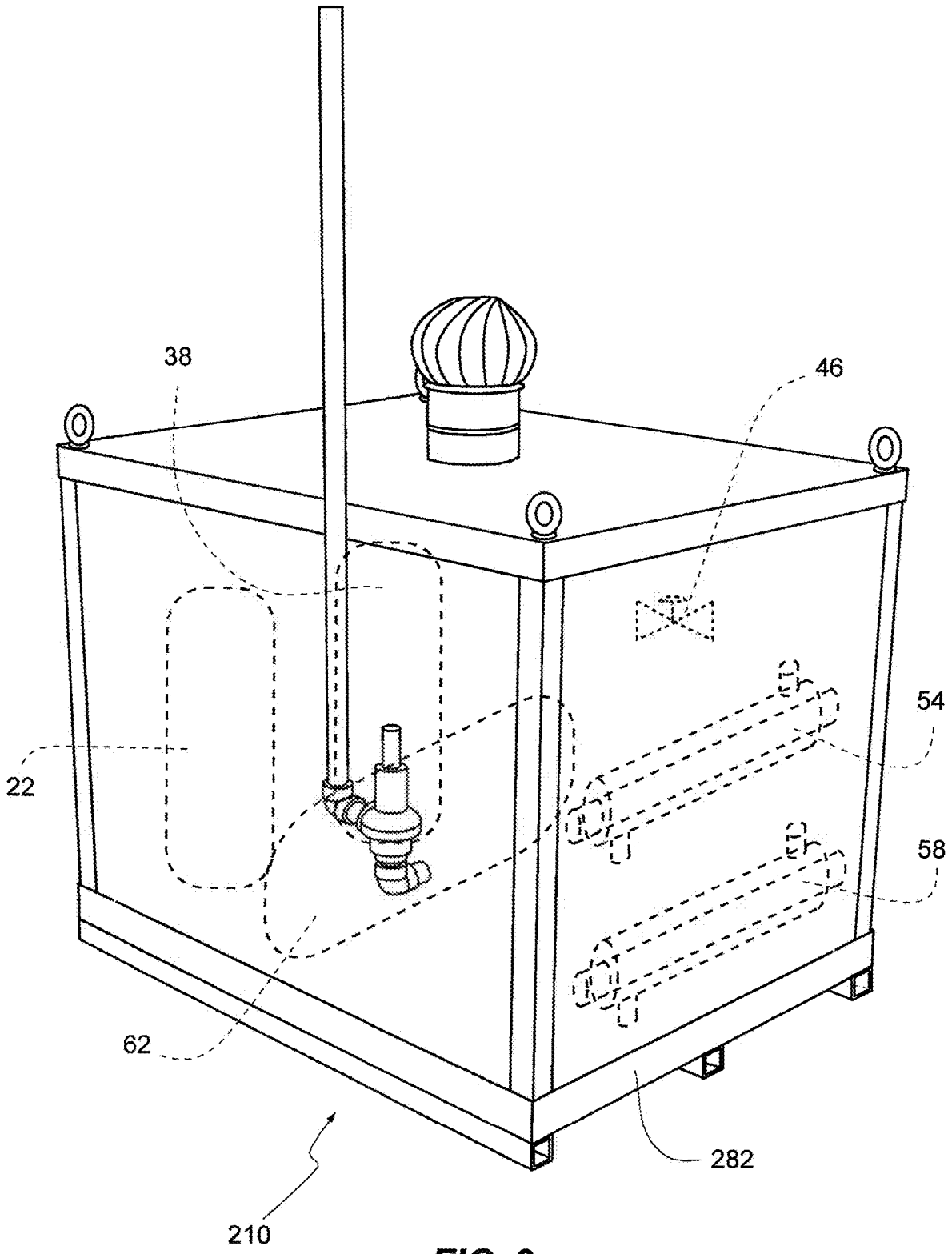
FIG. 3 is a perspective view of another gas-lift treatment system in accordance with another embodiment.

Referring to FIG. 3 another gas-lift treatment system 210 is shown in accordance with another embodiment. The system 210 is similar in many respects to the systems 10 and 110 described above, and which description is hereby incorporated herein by reference. The description of the system 210 applies to the systems 10 and 110 above as well. In another aspect, the system 210 can further comprise a mobile skid 282 to be deliverable to a well site or any location requiring gas processing. The first and second separators 22 and 38, the valve 46, the third 3-phase separator 62, and the first and second heat exchangers 54 and 58 can be carried by the skid 282. The mobile skid 282 can be transportable, and thus delivered and retrieved from a well site or any location requiring gas processing. The skid 282 can have a base that can be disposed on the ground adjacent the well head or gas producing facility. The skid 282 can have a floor, a roof, and a perimeter wall. The floor can be configured to be elevated and/or to have lower openings below the floor to accommodate the forks of a forklift. In another aspect, the skid 282 can have eyelets secured to a top thereof to allow the mobile skid 282 to be lifted with hooks, cables and a crane or loader.

In another aspect, the gas lift treatment system 10, 110 or 210 can be integrated with additional system for fuel gas treatment, where a slip stream can be taking from the treated gas and used to provide lean fuel gas to the compressor (not shown). If integrated, the NGLs stripped from the fuel gas conditions system can be recovered in the NGL/water separator of the gas-lift treatment system. This improves compressor operation (no derating) and also permits that the stripped BTUs be recovered in the form of NGLs.

A method for treating lift gas, and for using the lift gas treatment system described above, can comprise:

1) separating liquid water 26 from a high-pressure rich lift gas by passing the rich lift gas through a first separator 22 resulting in high-pressure pre-conditioned lift gas 30 containing high-pressure hydrocarbon liquids 32;

2) cooling the pre-conditioned lift gas 30 in first and second heat exchangers 54 and 58, resulting in cooled pre-conditioned lift gas;

3) separating the high-pressure hydrocarbon liquids 32 from the pre-conditioned lift gas 30 by passing the conditioned lift gas 30 through a second separator 38 resulting in separated cooled lower-density lift gas 42 and hydrocarbon liquids 32 with the presence of a smaller content of liquid water;

4) expanding the hydrocarbon liquids 32 in a throttling or Joule-Thomson effect to reduce the pressure and temperature of the hydrocarbon liquids 32 by passing the hydrocarbon liquids 32 through a valve 46 resulting in low-temperature and low-pressure hydrocarbon liquids 50;

5) passing the low-temperature and low-pressure hydrocarbon liquids 50 through the second heat exchanger 58 to cool the pre-conditioned lift gas 30; and 6) passing the cooled lower-density lift gas 42 through the first heat exchanger 54 to cool the pre-conditioned lift gas 30 and heat the lower-density lift gas 42, resulting heated lower-density lift gas 74.

The method can further comprise: further heating the heated lower-density lift gas 74 by passing the heated lower-density lift gas 74 through a third heat exchanger 174; and cooling the rich lift gas prior to flow through the compressor aftercooler 178 by passing the rich gas through the third heat exchanger 174.

The method can further comprise natural gas liquids (NGL) stabilization by separating water 26, NGLs 66 and flashed hydrocarbon gases from the low-temperature and low-pressure hydrocarbon liquids 50 by passing the hydrocarbon liquids 50 through a third separator 3-phase separator 62.

The method can further comprise maintaining a pressure of the lift gas at between 600 to 1200 psig. The method can further comprise providing the lift gas after treatment with a temperature between 60 to 120° F.

The method can further comprise positioning a mobile skid 282 carrying the first and second separators 22 and 38, the valve 46, the third 3-phase separator 62, and the first and second heat exchangers 54 and 58 adjacent to a well site or any location requiring gas processing.

It is to be understood that the examples set forth herein are not limited to the particular structures, process steps, or materials disclosed, but are extended to equivalents thereof as would be recognized by those ordinarily skilled in the relevant arts. It should also be understood that terminology employed herein is used for the purpose of describing particular examples only and is not intended to be limiting.

Furthermore, the described features, structures, or characteristics may be combined in any suitable manner in one or more examples. In the description, numerous specific details are provided, such as examples of lengths, widths, shapes, etc., to provide a thorough understanding of the technology being described. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts described herein. Accordingly, it is not intended that the invention be limited, except as by the claims set forth below.

What is claimed s:

1. A gas-lift treatment system, comprising:

a) an inlet configured to be coupled to a high-pressure and high-temperature rich lift gas source;

b) a first separator coupled to the inlet and configured to separate water from the rich lift gas resulting in high-pressure and high-temperature pre-conditioned lift gas containing high-pressure and high-temperature hydrocarbon liquids;

c) a second separator coupled to the first separator to receive the pre-conditioned lift gas and configured to separate the hydrocarbon liquids from the pre-conditioned lift gas resulting in separated cooled lower-density lift gas and hydrocarbon liquids;

d) a valve coupled to the second separator and configured to receive the hydrocarbon liquids and to expand the hydrocarbon liquids in a Joule-Thomson effect to reduce the pressure and temperature of the hydrocarbon liquids resulting in low-temperature and low-pressure hydrocarbon liquids;

e) a first heat exchanger coupled between the first and second separators and configured to transfer heat from the pre-conditioned lift gas to the separated cooled lower-density lift gas;

f) a second heat exchanger coupled between the first heat exchanger and the second separator and configured to transfer heat from the pre-conditioned lift gas to the low-temperature and low-pressure hydrocarbon liquids;

g) a third 3-phase separator coupled to the second separator and second heat exchanger and configured to receive the low-temperature and low-pressure hydrocarbon liquids and to separate water, flashed hydrocarbon gases and natural gas liquids (NGLs) from the low-temperature and low-pressure hydrocarbon liquids; and h) a treated lift gas outlet coupled to the second separator and the first heat exchanger and configured to provide heated lower-density lift gas.

2. The gas-lift treatment system in accordance with claim 1, further comprising:

a heat recovery exchanger coupled upstream of a compressor aftercooler, before the first separator, and coupled to the second separator and first heat exchanger, to transfer heat from the rich lift gas to the heated lower-density lift gas.

3. The gas-lift treatment system in accordance with claim 1, further comprising:

a mobile skid configured to be deliverable to a well site; and the first and second separators, the valve, the third 3-phase separator, and the first and second heat exchangers, being carried by the skid.

4. A gas-lift treatment system, comprising:

a) a pair of separators comprising:

i) a first separator configured to separate water from a rich lift gas resulting in high-pressure and high-temperature pre-conditioned lift gas containing high-pressure and high-temperature hydrocarbon liquids; and ii) a second separator coupled to the first separator to receive the pre-conditioned lift gas and configured to separate the hydrocarbon liquids from the pre-conditioned lift gas resulting in separated cooled lower-density lift gas and hydrocarbon liquids;

b) a pair of heat exchangers coupled between the pair of separators comprising:

i) a first heat exchanger configured to cool the pre-conditioned lift gas from the first separator by transferring heat to the separated cooled lower-density lift gas from the second separator; and ii) a second heat exchanger configured to cool the pre-conditioned lift gas from the first separator by transferring heat to the hydrocarbon liquids from the second separator; and c) a valve coupled between the second separator and the second heat exchanger and configured to receive the hydrocarbon liquids from the second separator and to expand the hydrocarbon liquids in a Joule-Thomson effect to reduce the pressure and temperature of the hydrocarbon liquids resulting in low-temperature and low-pressure hydrocarbon liquids.

5. The gas-lift treatment system in accordance with claim 4, further comprising:

a third 3-phase separator coupled to the second separator and second heat exchanger and configured to receive the low-temperature and low-pressure hydrocarbon liquids and to separate water, flashed hydrocarbon gases and natural gas liquids (NGLs) from the low-temperature and low-pressure hydrocarbon liquids.

6. The gas-lift treatment system in accordance with claim 4, further comprising:

a heat recovery exchanger coupled upstream of a compressor aftercooler, before the first separator, and coupled to the second separator and first heat exchanger, to transfer heat from the rich lift gas to the heated lower-density lift gas.

7. The gas-lift treatment system in accordance with claim 4, further comprising:

a mobile skid configured to be deliverable to a well site; and the first and second separators, the valve, the third 3-phase separator, and the first and second heat exchangers, being carried by the skid.

8. The gas-lift treatment system in accordance with claim 7, further comprising:

an inlet carried by the mobile skid and configured to be coupled to a high-pressure and high-temperature rich lift gas source, the first separator being coupled to the inlet; and a treated lift gas outlet carried by the mobile skid and coupled to the second separator and the first heat exchanger and configured to provide heated lower-density lift gas.

9. A method for treating lift gas, comprising:

a) separating water from a high-pressure and high-temperature rich lift gas by passing the rich lift gas through a first separator resulting in high-pressure and high-temperature pre-conditioned lift gas containing high-pressure and high-temperature hydrocarbon liquids;

b) cooling the pre-conditioned lift gas in first and second heat exchangers, resulting in cooled conditioned lift gas;

c) separating the high-pressure and high-temperature hydrocarbon liquids from the pre-conditioned lift gas by passing the pre-conditioned lift gas through a second separator resulting in separated cooled lower-density lift gas and hydrocarbon liquids;

d) expanding the hydrocarbon liquids in a Joule-Thomson effect to reduce the pressure and temperature of the hydrocarbon liquids by passing the hydrocarbon liquids through a valve resulting in low-temperature and low-pressure hydrocarbon liquids;

e) passing the low-temperature and low-pressure hydrocarbon liquids through the second heat exchanger to cool the pre-conditioned lift gas; and f) passing the cooled lower-density lift gas through the first heat exchanger to cool the pre-conditioned lift gas and heat the lower-density lift gas, resulting in heated lower-density lift gas.

10. The method in accordance with claim 9, further comprising:

a) further heating the heated lower-density lift gas by passing the heated lower-density lift gas through a third heat exchanger; and b) cooling the rich lift gas upstream of a compressor aftercooler by passing the rich lift gas through the third heat exchanger.

11. The method in accordance with claim 9, further comprising:

separating water and natural gas liquids (NGL) from the low-temperature and low-pressure hydrocarbon liquids by passing the hydrocarbon liquids through a third separator 3-phase separator.

12. The method in accordance with claim 9, wherein a pressure of the lift gas is maintained at between 600 to 1200 psig.

13. The method in accordance with claim 9, wherein a temperature of the lift gas after treatment is between 60 to 120° F.

14. The method in accordance with claim 9, further comprising:

positioning a mobile skid carrying the first and second separators, the valve, and the first and second heat exchangers adjacent to a well site.

* * * * *